US005355608A

United States Patent [19]

Teetzel

[11] Patent Number: 5,355,608

[45] Date of Patent: Oct. 18, 1994

[54] CONCEALED LASER MODULE SIGHT APPARATUS

[76] Inventor: James W. Teetzel, 14 Stratham Green, Stratham, N.H. 03885

[21] Appl. No.: 73,766

[22] Filed: Jun. 8, 1993

[51] Int. Cl.[5] ..... F41G 1/35; F41G 1/36

[52] U.S. Cl. ..... 42/103; 362/113

[58] Field of Search ..... 42/103, 100, 1.06; 362/110, 113, 114; 89/14.3, 14.05

[56] References Cited

U.S. PATENT DOCUMENTS

| | | | |
|---|---|---|---|
| 1,201,052 | 10/1916 | Jakubyansky | 42/103 |
| 1,263,667 | 4/1918 | Henderson et al. | 362/114 |
| 2,464,010 | 3/1949 | Vonella | 89/14.05 |
| 4,715,140 | 12/1987 | Rosenwald | 89/14.3 |
| 4,934,086 | 6/1990 | Houde-Walter | 42/103 |

FOREIGN PATENT DOCUMENTS

| | | | |
|---|---|---|---|
| 3546295 | 7/1987 | Fed. Rep. of Germany | 42/103 |

*Primary Examiner*—Stephen M. Johnson
*Attorney, Agent, or Firm*—William B. Ritchie

[57] ABSTRACT

A laser sight that can be concealed within a standard autoloading handgun. The invention features a chassis that is mounted to the front face of the slide of the handgun. The chassis has the same cross-sectional profile of the handgun and extends the slide by only about three quarters of an inch. Therefore, the handgun can be carried in standard holsters. The standard spring recoil guide is replaced by a novel battery pack designed to be used with commercially available batteries providing about 12 hours of operating time. The device is activated by a three different membrane switches, one on the chassis itself to select between an infrared laser, a "red" laser, and an incandescent light; a second membrane switch on the trigger which activates the sight when a slight pressure is applied; a third membrane switch located on the side of the frame so that the sight can be activated without placing a finger on the trigger. A delay feature is featured with the third switch so the user can move his finger from the frame switch to the trigger switch without the sight being turned off.

12 Claims, 8 Drawing Sheets

CONCEALED LASER MODULE SIGHT APPARATUS

BACKGROUND OF THE INVENTION

1. Field of the Invention

The invention relates to laser sights for use on small firearms, particularly semi-automatic handguns.

2. Description of the Related Art

It is well known that even skilled marksman with a handgun have been unable to hit a target as close as 7 meters when attempting to draw the weapon and fire at speed. In target shooting, the shooter must obtaining the proper stance by carefully positioning the feet and the "free" hand to find the most stable condition, producing no muscular strain that will adversely effect the accuracy of the shot. Most importantly, the shooter must be able to obtain an identical position each time the weapon is fired to achieve the greatest accuracy. As the whole upper torso moves during each breath, breath control plays a vital role in the process. Since there can be no body movement at the time the trigger is fired, obviously the act of breathing must be stopped during the time the weapon is aimed and fired.

Sight picture and aim are critical if the shooter is to fire the most accurate shot or series of shots. When a mechanical pistol sight is properly aligned, the top of the front sight should be level with the top of the rear sight, with an equal amount of light on either side of the front sight. Using this sight picture requires that the shooter focus his shooting eye so that the sights are in focus and the target is out of focus. Added to the difficulty, the trigger, all of the above must be maintained while the trigger is released using direct, even pressure to keep the barrel of the gun pointing at the target. These skills require tremendous practice, with each shot fired needing the utmost concentration if the shooter is to obtain maximum accuracy.

It is clear that the recommended methods of achieving maximum shooting accuracy useful for target shooting, must be severely modified when a handgun is used in a law enforcement situation. While the degree of accuracy necessary for target shooting and the distances and substantial lower, accuracy is still vital. Law enforcement official are instructed to fire only as a last resort, cognizant of the fact that their intended target will mostly be killed. Shooting to wound occurs only in the movies. Law enforcement officers typically use higher caliber handguns, mostly 9 mm, which are designed to immobilize with a single shot if that shot strikes a vital area. Given the inherent inaccuracies in the shooting process itself, exacerbated by the stress and fear of the police officer in what may be a life threatening situation for him/her, the exact location of the bullet where millimeters can mean the difference between death and survival cannot be known a priori by the even the most skilled marksman.

Mechanical sights have limited value in many situation where an officer must quickly draw his gun, perhaps while moving, and fire at a close target without sufficient time to properly obtain a sight picture. Under these circumstances, instinctive aiming, that is, not using the sights but rather "feeling where the gun barrel is pointing using the positioning of the hand holding the gun, is the preferred method. While this method, akin to the typical television cowboy shootouts, can be reasonably effective at short distances, obviously large errors in aiming are easily introduced, especially when the officer must frequently fire his/her weapon from a different hand position that has been used for practice. For example, bullet proof shields are used to protect the officer from being fired upon such as in a riot situation. In those circumstance, the officer must reach around his/her shield or other barricade and instinctively aim and fire his/her gun with the handgun in a very different orientation that would be experience if fired from a standing, drawn from a holster position. Small changes in barrel orientation due to the sight radius of the typical law enforcement handgun can produce substantial errors relative to the target. Accurate instinctive shooting is not considered practical beyond 20 feet for the average shooter.

A solution to this problem has been the introduction of laser sights for use with handguns. The typical laser sight is mounted on the top on the handgun or on the bottom. The laser sight when properly aligned, places a red light dot on the target where the bullet will strike if the gun is fired. Using this type of sight, enables the law officer to rapidly instinctively properly position the weapon and be certain of his/her intended target. Using a laser sight enables accurate shots to be fired at distances of more than 50 feet, sufficient for most combat law enforcement situations requiring the use of handguns.

U.S. Pat. No. 4,934,086, issued to Houde-Walter on Jun. 19, 1990, discloses installing the laser sight within the recoil spring guide. The use of the recoil spring guide to house the laser sight components enables the firearm to be holstered in a normal manner. The use of the spring recoil guide presents alignment problems to ensure accuracy. In other words, the laser within the recoil guide is difficult to align with the barrel of the firearm. Therefore, misalignment of the sight resulting in poor accuracy is likely.

However, prior art laser devices have several disadvantages. As they are mounted either on the top or the bottom of the weapon, the balance of the gun is disturbed which makes it more difficult for the shooter to rapidly use his/her instinctive sighting technique to move gun into alignment for hitting the desired target. Also, since prior art laser sights are very bulky in comparison to traditional mechanical sights, the weapon cannot be used in a standard holster. Further, the laser sight is extremely vulnerable to being hit due to extending substantially beyond the normal profile of the weapon and thereby misalignment of the sight and defeating the advantages offered by the laser sight. A laser sight capable of being installed in a semi-automatic handgun, easily and accurately adjustable, is not disclosed in the prior art.

SUMMARY OF THE INVENTION

It is an object of the invention to provide a laser module sight apparatus that is completely concealed within the standard framework of the handgun.

It is another object of the invention to provide a laser module sight apparatus that can be retrofitted to standard semi-automatic handguns.

It is still another object of the invention to provide a laser module sight apparatus that enables the gun to be used with standard holsters designed for that particular weapon.

It is still another object of the invention to provide a laser module sight apparatus that can be fitted to various semi-automatic handguns requiring a minimum replacement of standard parts.

It is another object of the invention to provide a laser module sight apparatus that can easily adjusted by the user to permit accurately alignment of the laser sight with the barrel of the gun.

It is another object of the invention to provide a laser module sight apparatus that can be inexpensively produced using primarily commercially available parts.

It is another object of the invention to provide a laser module sight apparatus that can incorporate an infrared diode that makes the dot invisible to the naked eye, but clearly visible using standard night vision equipment.

It is still another object of the invention to provide a laser module sight that can easily substitute a flashlight bulb in place of the laser diode.

It is another object of the invention to provide a laser module sight apparatus that is extremely light compared to existing lasers and their mounts.

It is still another object of the invention to provide a laser module sight apparatus that can be activated from a trigger switch or a frame mounted switch.

It is another object of the invention to provide a laser module sight apparatus that can be powered by commercially available batteries, providing at least several hours of service time before needing to be changed.

It is another object of the invention to provide a laser module sight apparatus that will incorporate a delay when the frame mounted switch is deactivated before the laser is turned off, thus permitting time for the user to activate the trigger switch without losing sight on the target.

Finally, it is another object of the invention to provide a laser module sight apparatus that eliminates the need for a pressure pad on the grip handle which is awkward when holding the gun and requires adjustments to the shooter's grip to keep the laser off while maintaining stability.

The invention is a laser sight for an autoloading handgun, said handgun having a barrel and a spring recoil guide, a trigger, a frame, a slide having a cross-sectional profile with a front face having two holes therein, with one hole corresponding to the diameter of the barrel and the other hole corresponding to the diameter of the spring recoil guide. The invention has a chassis, having a cross-sectional profile corresponding to the cross-sectional profile of the slide of said handgun, said chassis having a front face, a back face, and having two holes extending therethrough from the back face to the front face of said chassis, with the holes corresponding to the holes in the front face of the slide of said handgun, with said chassis having at least one light source wherein the light of said light source is emitted from the front face of said chassis, and with the back face of said chassis securely mounted on the front face of the slide of said handgun.

DETAILED DESCRIPTION OF THE INVENTION

Figure 1:
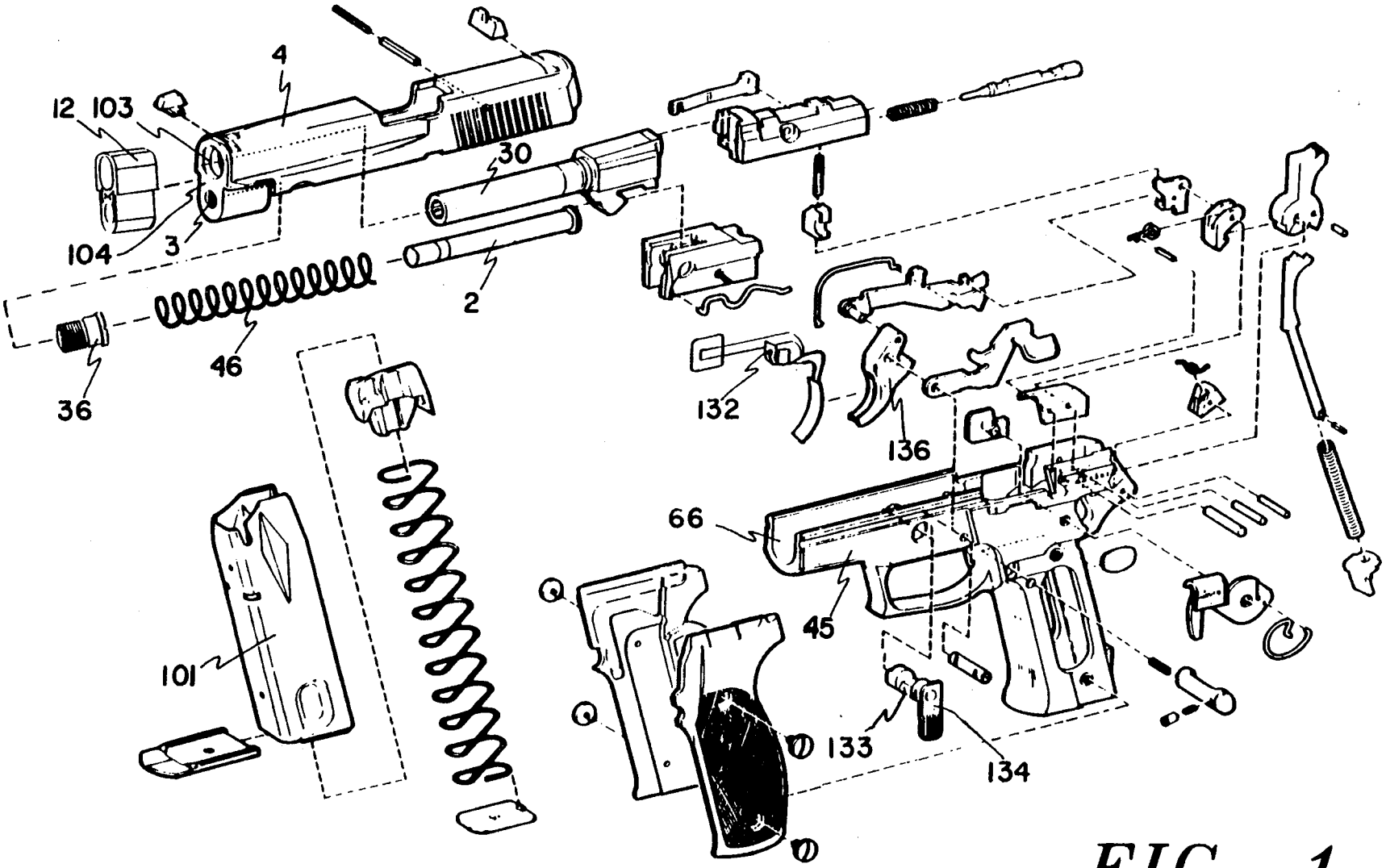
FIG. 1 is a breakdown view of typical autoloading handgun, in this, the SIG Model P228.

FIG. 1 is breakdown view of a typical autoloading handgun which can be adapted to incorporate a concealed laser module sight in accordance with the invention. The pistol shown is SIG-SAUER Model P228, 9 mm, with a 13 cartridge clip or magazine 101. This particular pistol has been adopted by numerous military and law enforcement agencies as the weapon of choice because of its large magazine capacity, reliability, and accuracy. In operation, slide 4, guided by recoil spring guide 2 and tensioned by recoil spring 46, is slid backwards along frame 45, tensioning recoil spring 46. Barrel 30 and recoil spring guide 2 extend through barrel hole 103 and recoil spring guide hole 3 respectively. Once slide 4 is released, spring 46 causes slide 4 to move forward, strip a round (not shown) from magazine 101, and place the cartridge into the firing chamber of barrel 30. When slide 4 is in its most forward position on frame 45, recoil spring guide 2 and barrel 30 are substantially flush with front face 104 of slide 4 via their respective holes 3 and 103.

Some autoloading handguns, such as the Colt Government Model 45 (not shown), incorporate a barrel bushing that positions barrel 30 within barrel hole 103 of slide 4. The barrel bushing in that model extends slightly beyond the front face 104 of slide 4. Other, such as the S & W Model 39, incorporate a barrel bushing that also acts as a bushing for recoil spring guide 2. The S & W bushing occupies a substantial portion of the front face 104 of slide 4. However, the invention can be adapted to fit any autoloading handgun by merely making minor changes as will be shown later.

The invention takes advantage of the basic design of this type of firearm. Recoil spring guide 2 is modified to house a concealed battery compartment to power a laser that is mounted in a chassis, adapted to be attached to the front face 104 of slide 4. Further, the chassis is provided with holes corresponding to barrel hole 103 and spring recoil guide hole 3 so that the normal functioning of the firearm does not have to altered. This enables the handgun to function in every respect the same as a firearm not equipped with laser sight if the sight is not turned on. Yet, when the laser sight is needed, the invention is easily activated by a conveniently placed switches will be discussed below.

Figure 2:
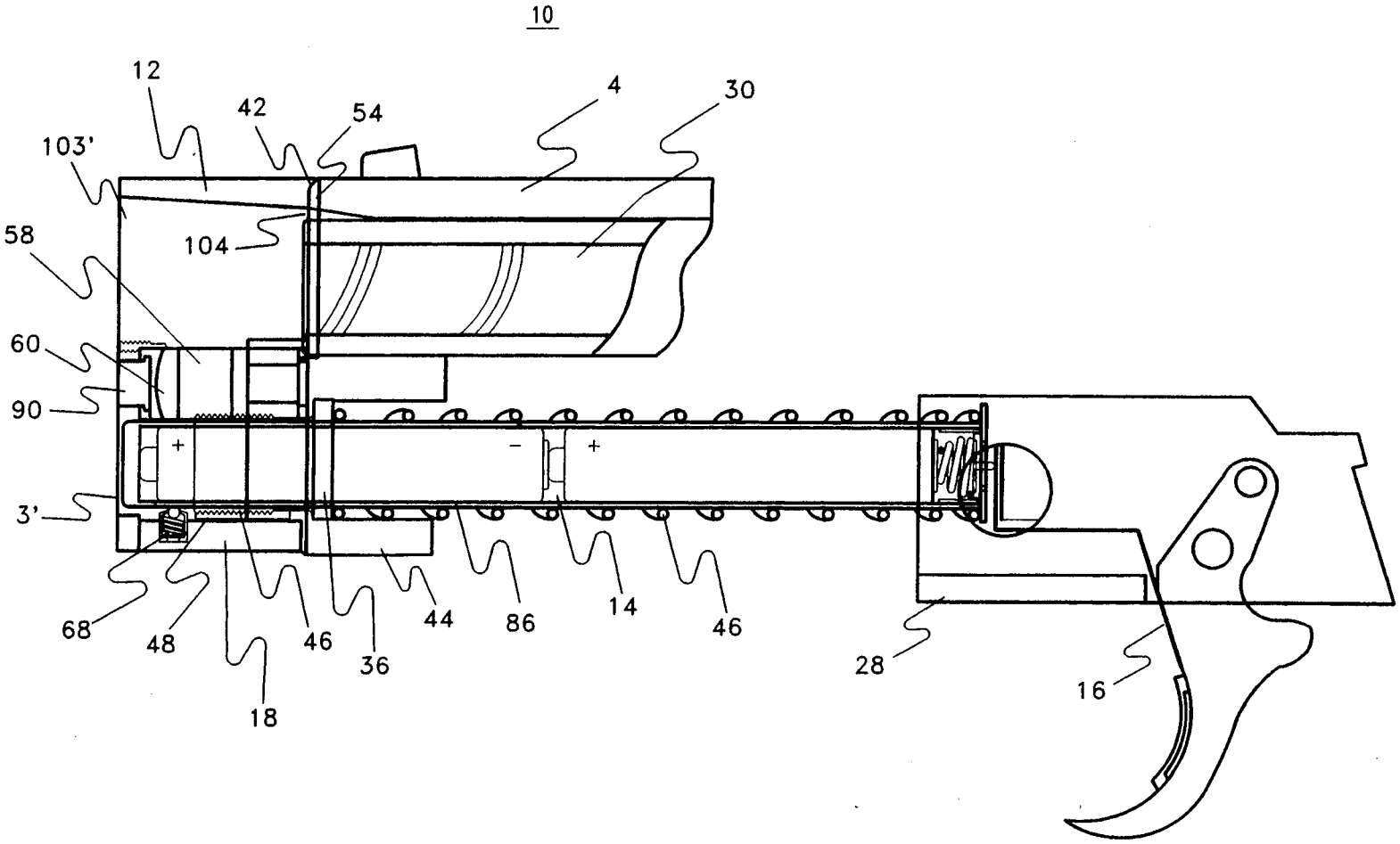
FIG. 2 is a cross-sectional view of the laser diode sighting system attached to the autoloading handgun shown in FIG. 1 in accordance with the invention.

FIG. 2 is a cross-sectional view of the laser diode sighting system 10 attached to the autoloading handgun shown in FIG. 1 in accordance with the invention. The laser diode sighting system 10 has five subsystems, laser diode chassis 12, retaining bushing 36, membrane switch 18, recoil spring guide battery pack 14 and the trigger switch 16.

The laser diode chassis 12 is dimensioned to have the same profile as slide 4. Chassis 12 also has holes 103' and 3' that correspond to barrel hole 103 and spring recoil guide hole 3. Since the barrel 30 of the Sig Model P288 tilts upward when slide 4 is in the fully retracted position, hole 103' is modified accordingly. Also, hole 3' is dimensioned to allow recoil spring guide 2 to slide through when slide 4 travels backwards.

Since system 10 mounts on the front face 104 of slide 4, little modification of the handgun is required. The major internal modification is replacing the standard spring recoil guide 2 with battery pack 14.

Chassis 12 is held in place on front face 104 by means of retaining bushing 36. As shown, chassis 12 mounts on the front slide face 104 of the slide 4. Retaining bushing 36 extends from the inside the spring housing 44 of the slide 4 out through the recoil spring guide hole 3 where as the threads 46 extended out, screw into the chassis threaded hole 48 in chassis 12. Bushing 36 has an opening 51 that corresponds to diameter of battery pack 14 so that battery pack 14 may easily slide therethrough.

Figure 3:
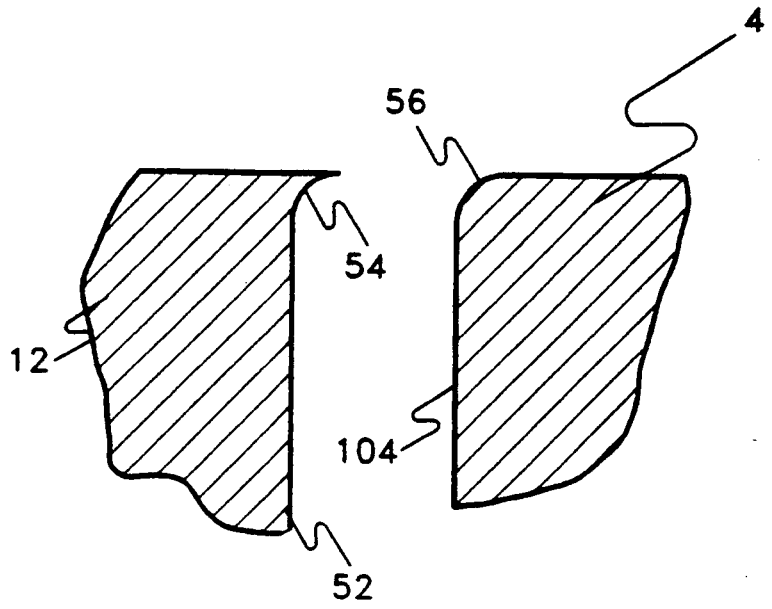
FIG. 3 is a detailed cross-sectional view of the sighting system chassis locked to the slide of the typical handgun.

Bushing 36 holds the back surface 52 of chassis 12 snug against the front slide face 104 of the slide 4. As shown in the detail FIG. 3, locking radiuses 54 prohibit the laser diode chassis 12 from rotating by matching with radius 56 on front of slide 4. This is a preferred method. Other methods may be by gluing, pinning, notching, etc. depending on the configuration of the front face 104 of slide 4. For example, for handguns that use a barrel bushing, a second bushing may be used in addition to bushing 36 or in lieu of, to hold chassis 12 firmly in place.

Laser diode chassis 12 is preferably made of a heat treatable steel material. This would make a more durable housing to resist against damage. However, other materials for chassis 12 are also suitable such as hard plastic and aluminum.

Lens protector 90 will be glued in from the inside of the laser diode chassis 12. Lens protector 90 is preferably made of material that is clear to allow a light beam to travel through it without distorting it and will resist flash burns, residue, abrasion and keep water and dirt from getting into the laser diode chassis 12. Clear glass would be a preferable material.

Figure 4:
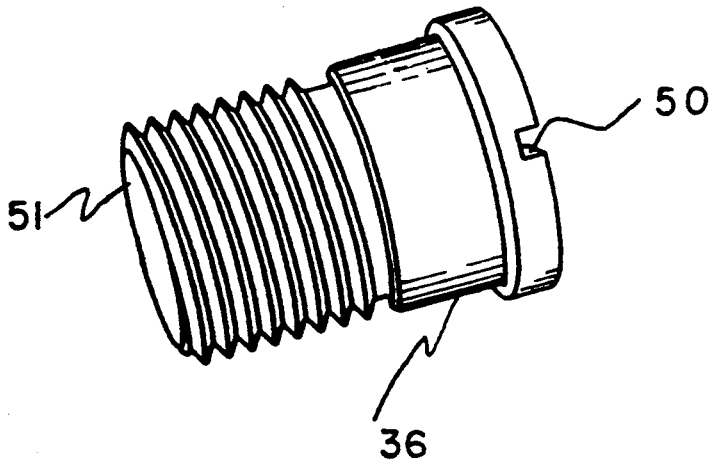
FIG. 4 is a detailed isometric view of the chassis bushing.

As shown in FIG. 4, retaining bushing 36 is preferably made of a high tensile stainless steel that resists cracking. Slot 50 in retaining bushing 36 allows for ease of installation with a screwdriver.

Figure 5:
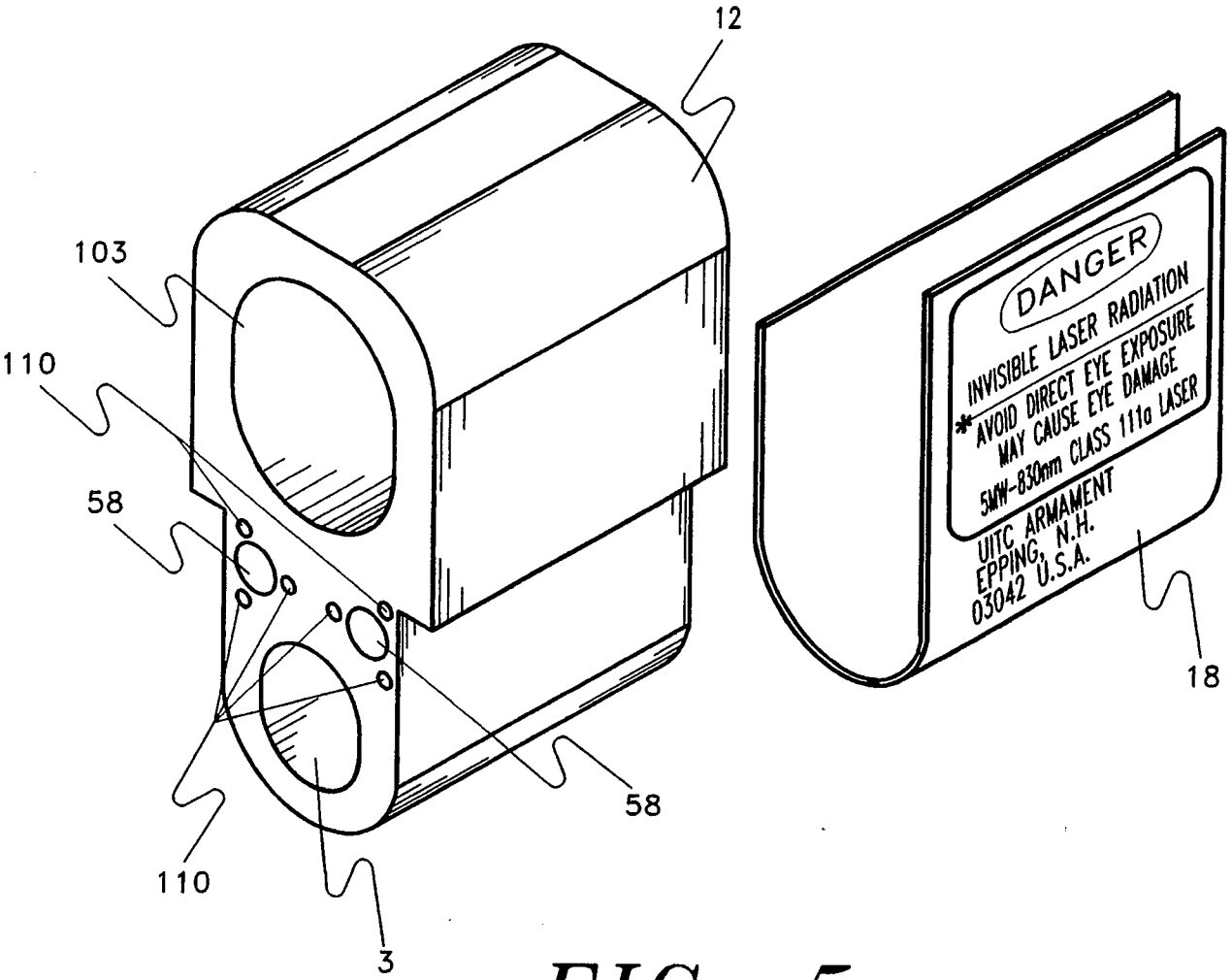
FIG. 5 is a front isometric view of chassis.

FIG. 5 is a front isometric view of chassis 12 and membrane switch 18. Chassis 12 houses one or more laser diode lights 58 with a collimating lens 60 (shown in FIG. 2). Laser diode light 58 with a collimating lens 60 is preferably the type manufactured by Roam or Lyte Obtronics. It should be recognized that light 58 could also be a standard incandescent bulb to act as a flash light. The laser diode light 58 with a collimating 60 can be positioned anywhere on the face 64 of the chassis. However, the preferable placement is as shown with one light opening 58 emitting a red beam and the other light opening 58 emitting an infrared beam to be detected by night vision goggles.

The precise positioning of lights 58 can be manipulated by turning in and out three socket head set screws 110 equally spaced located on face 64. Socket head set screws 110 are preferably 2-56 UNEF socket head set screw modified with chamfer. This allows wedging along surface light 58 thereby aligning laser diode light 58 with collimating lens 60 in relation with barrel 30. The preferred method of mounting the chassis to the slide limits the amount of stack-up tolerances in relation to the laser diode and the center line of the barrel, whereas, prior art devices mount the diode in other locations, such below the slide or in the recoil guide, which may substantially effect the accuracy of the sighting apparatus.

By enabling the shooter to easily adjust alignment of the laser diode light 58 in relation with the barrel, the shooter can reflect his/her personal shooting habits such as pulling the pistol to one side when the trigger is pulled.

Referring again to FIG. 2, laser diode 58 with a collimating lens 60 could also be positioned off from the centerline of the barrel 30 and reflected out of light opening by using a prism.

The exact placement and orientation of the laser diodes within chassis 12 and light openings 58 can be varied as long as face 64 of chassis 12 does not extend greater than the face 104 of slide 4. When the gun is fired, and it recoils, the slide 4 travels backward with the frame 45 as is shown in FIG. 1. Clearance is required between chassis 12 and cavity 66 of frame 45.

Figure 6:
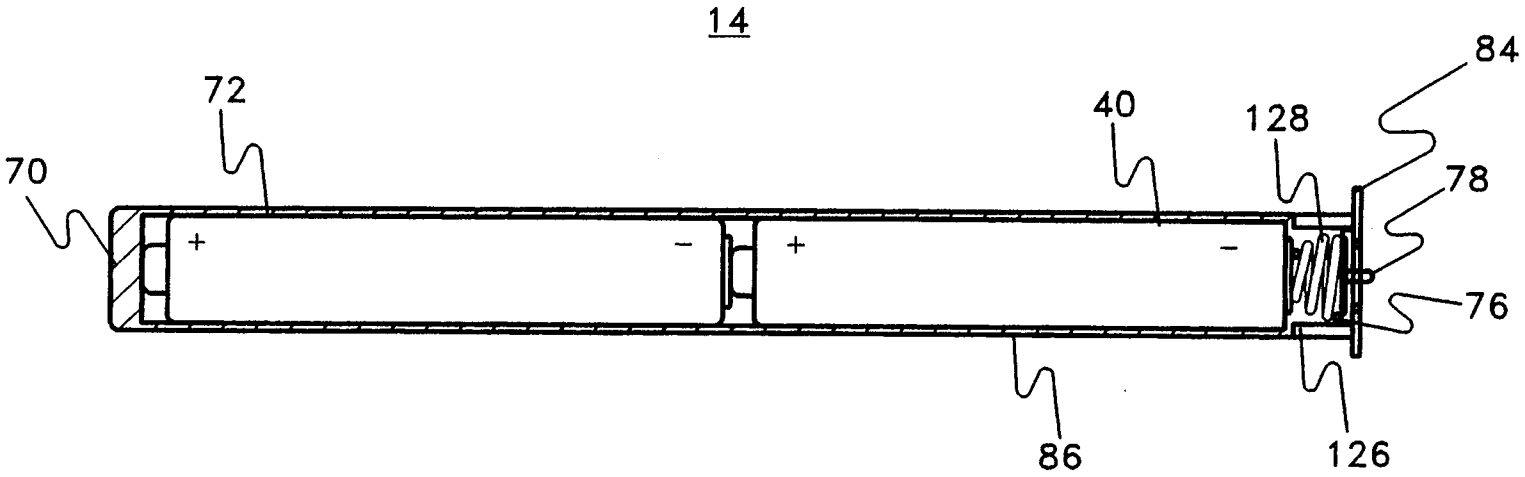
FIG. 6 is a cross-sectional view of the batten pack.

Referring now to FIG. 6, the details of battery pack 14 and its operation will be presented. The invention requires a recoil spring guide battery pack 14 to energize the laser diode chassis 12. Battery pack 14 is electrically connected to frame 45 via springloaded electric contact pin 68 as shown in FIG. 2. Spring-loaded electric contact pin 68 is required so that when the gun is fired and the slide 4 with the laser diode chassis 12 attached will ride along the surface housing 86.

Pin 68 is the preferred method, however, a roller, or a deformed piece of metal could be used to contact the front cap 70 of the recoil spring guide battery pack 14. The electric operation requires the gun to become the ground or negative charge. This is accomplished by having a battery insulator 72, insulate the positive charge from the main housing 86 of the recoil spring battery pack 14. The negative charge of the recoil spring battery pack 14 is insulated in the same fashion.

Battery pack 14 has a front cap 70 preferably a heat treated steel, that is bonded to a non conductive material preferably black DELRON or ABC polymer plastic material called battery insulator 72. The battery insulator 72 is then bonded to the main housing 86. Preferred material is heat treated steel. The wall thickness is relatively thin to minimize the overall diameter of the recoil spring guide battery pack 14.

Two $1\frac{1}{2}$ volt batteries 40 preferably EVERREADY E96VP will be replaceable by unscrewing spring cap 126 from main housing 74. The spring cap 126 will house the aft insulator 76, a contact point 78 preferably brass that is tin plated to prevent corrosion, and a spring 128. The spring 128 takes up whatever distance there may be caused by manufacturing tolerances of the AAAA battery 40. Spring 128 will be attached to contact point 78 by soldering as preferred method. Spring 128 also serves as a shock absorber to counter the recoil shock when the firearm is discharged.

Contact point 78 will be bonded to aft insulation 76 using epoxy as preferred method. Aft insulation 76 will be bonded to spring cap in a similar fashion.

This is insulated by aft insulation 76 allowing only for the main housing 86 to have a negative charge when the trigger switch is activated.

Figure 7:
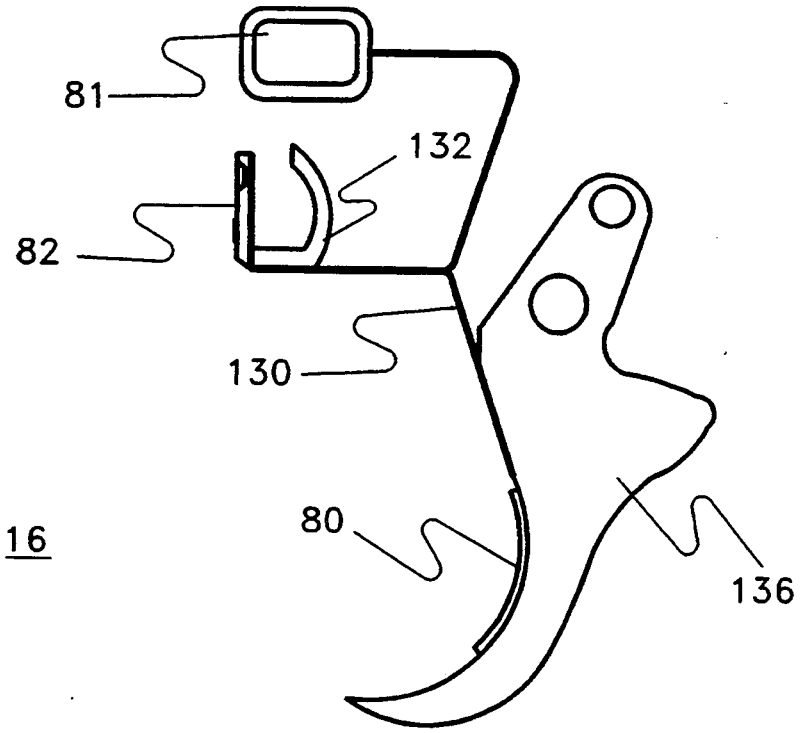
FIG. 7 is a detailed view of the trigger switch.

Referring now to the FIG. 7, the contact point 78 allows for a circuit to be complete when the laser is activated by depressing trigger membrane switch 80 on trigger 136 . A closed circuit is present across face 82. Face 82 then creates a circuit through surface contact 84 (shown in FIG. 6). This is a preferred method of switching. There are many other ways by means of switching using a phototransducer/LED switch, a transmitter/receiver, etc. As shown in FIG. 7., trigger switch 16 is a membrane switch with electric terminals 130. The pad 82 will be bonded to the take down retainer 132 with the preferred method of bonding being epoxy. The take down retainer 132 snaps in the cavity 133 of take down lever 134 (shown in FIG. 1) with the loose electric terminal 130 it allows the shooter to rotate the take down lever 134 to strip the slide 4 from the frame 45. This is a normal operation to clean the gun. The pad 80 is bonded to the trigger 136 using a sticky backed paper. Pad 80 is a pressure sensitive switch which is in the "on" condition when the shooter presses pad 80 and is in the "off" when released.

A second pad 81 can be mounted to frame 45 so that sight 10 can be activated without the shooter placing a finger on the trigger 136. The placement of pad 81 will depend on whether the shooter is right or left-handed. Pad 81 can also activate sight 10. However, when pad 81 is released, a slight delay, supplied by membrane switch 18, occurs before the sight is shut-off, thus giving the shooter time to activate the sight using pad 80. This prevents the shooter from losing his/her sight picture of the target in the brief time it takes for the shooter to move his/her finger from pad 81 to pad 80.

Figure 8:
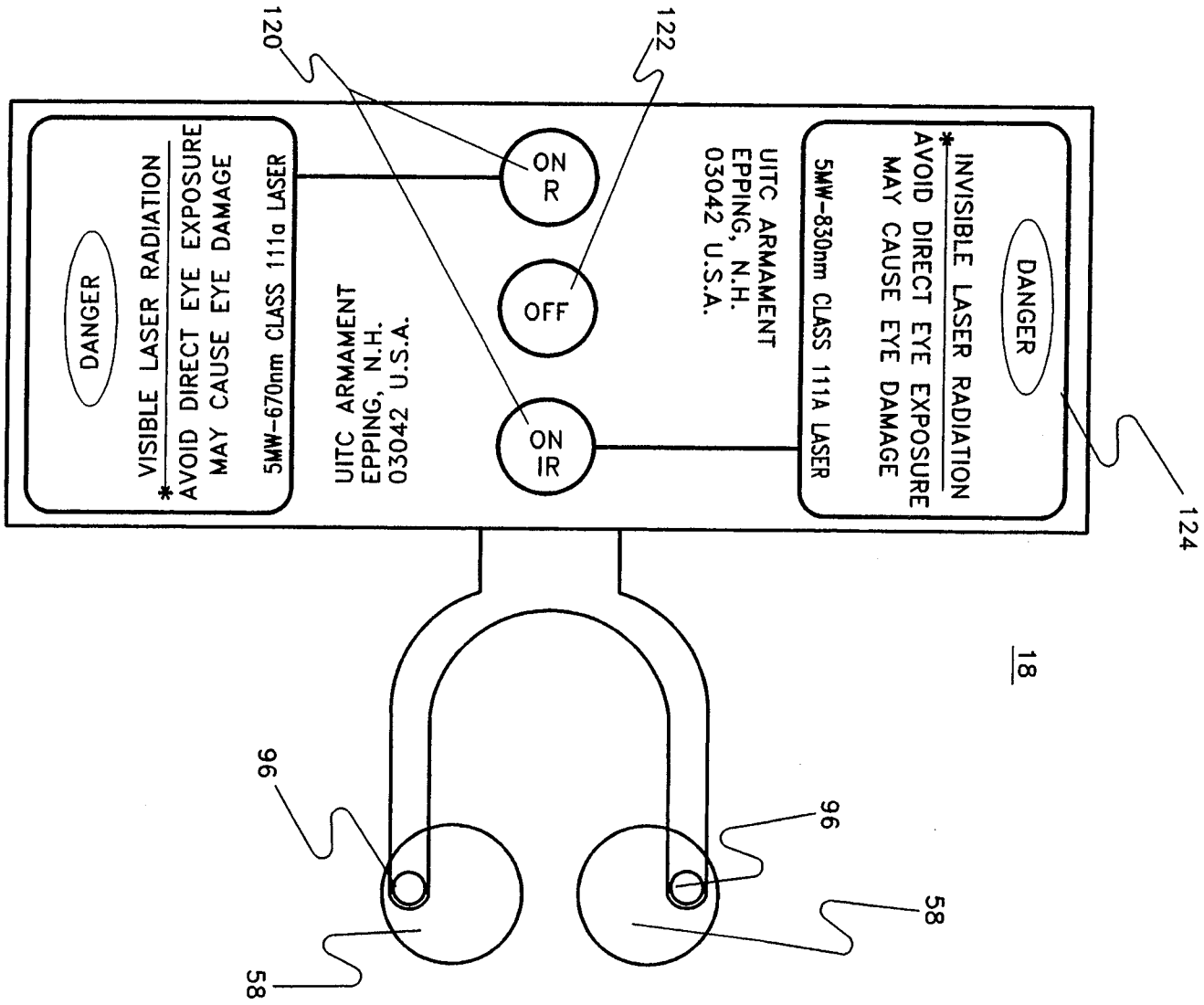
FIG. 8 is a detailed flattened view of the membrane control switch.

FIG. 8 is a detailed flattened view of the membrane control switch. Membrane control switch 18, preferably made of shock resistant plastic molded chassis with built-in switching circuitry such as manufactured by SPECTRA SYMBOL. Membrane switch 18 acts as an electrical circuit to energize and control the infrared and/or visible laser. On buttons 120, and off buttons 122 allow the shooter to preselect an environmental condition or switch hit back, if the shooting conditions change. Membrane switch 18 also accommodates laser warning labels 124 as shown. Membrane switch 18 provides connection to laser diode 58 via electrical contacts 96. Membrane switch 18 is preferably bonded to chassis 12 using epoxy.

Figure 9:
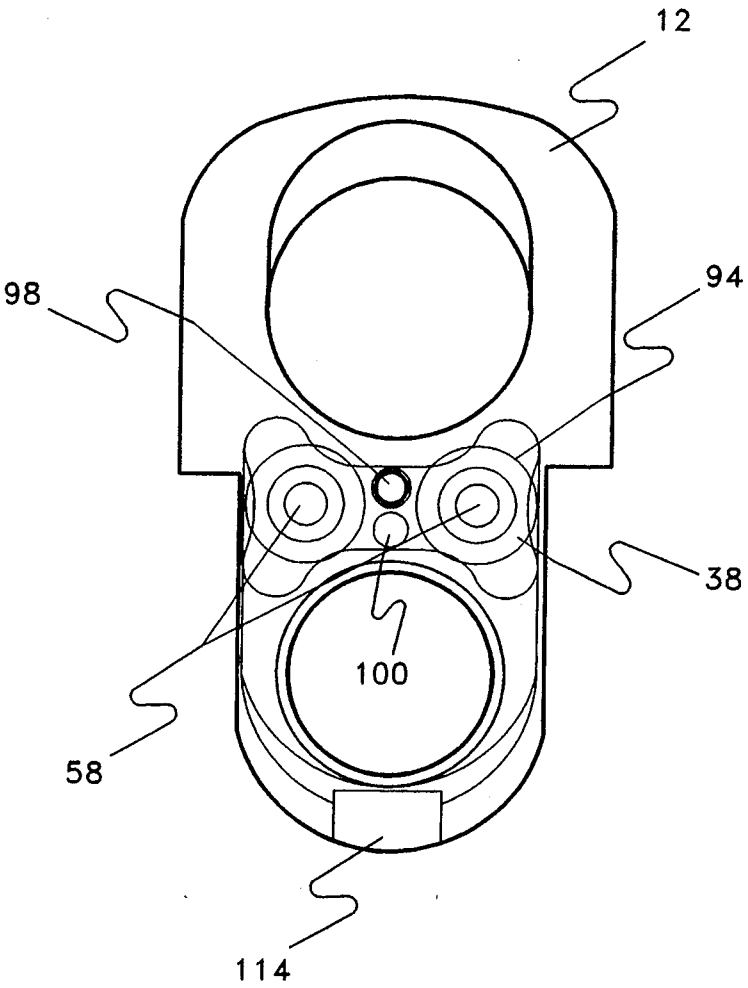
FIG. 9 is rear view of the chassis showing the retainer member in place.

FIG. 9 is rear view of chassis 12 showing the retainer 38. The "dog bone" shaped retainer 38 is preferably made of heat treatable steel will be fastened down by a socket head cap screw 98 and a locating pin 100. The purpose of retainer 38 is to hold diode 58 in place in chassis 12 (shown in outline) and to ensure that a good electrical contact is made. Pocket 114 will allow a space for the membrane switch 18 to lay into when assembled.

Figure 10:
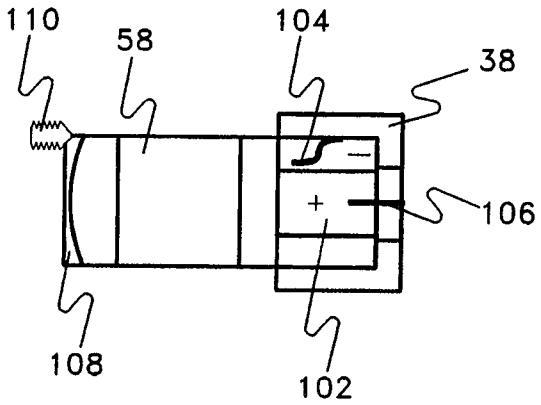
FIG. 10 is cross-sectional view of the laser module assembly within the chassis.

Referring now to FIG. 10, laser diode light 58 will have one negative lead 104 that will ground to retainer 38 on surface 94 (shown in FIG. 9) and a positive lead 106 that will contact with switch contact 96 of membrane switch 18 (shown in FIG. 8) when assembled in place. Retainer 38 will also allow the back end 102 of the laser diode light 58 to pivot when adjusted using alignment screws 110.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. A laser sight for an autoloading handgun, said handgun having a barrel and a spring recoil guide, a trigger, a frame, a slide having a cross-sectional profile with a front face having two holes therein, with one hole corresponding to the diameter of the barrel and the other hole corresponding to the diameter of the spring recoil guide, said laser sight comprising:

a chassis, having a cross-sectional profile corresponding to the cross-sectional profile of the slide of said handgun, said chassis having a front face, a back face, and having another two holes extending therethrough from the back face to the front face of said chassis, with said another two holes corresponding in positional alignment to the holes in the front face of the slide of said handgun, with said chassis having at least one light source;

a battery pack dimensioned to fit within the spring recoil guide of said handgun and to power said light source; wherein the light of said light source is emitted from the front face of said chassis, and with the back face of said chassis securely mounted on the front face of the slide of said handgun.

2. The laser sight of claim 1 further comprising a retainer bushing to lock said chassis to the front face of the slide of said handgun.

3. The laser sight of claim 2 further comprising a first membrane switch, attached to said chassis, wherein said switch electrically connects said light source to said battery pack.

4. The laser sight of claim 3 further comprising a second membrane switch, attached to the trigger of said handgun, wherein a user may activate said light source by pressing on said second membrane switch with a pressure sufficient to cause said second membrane switch to make contact but insufficient pressure to cause said handgun to fire.

5. The laser sight of claim 4 further comprising a third membrane switch, attached to the frame of said handgun, wherein the user may activate said light source by pressing on said third membrane switch.

6. The laser sight of claim 5 further comprising delay means for delaying the time that said light source is turned off once the user releases pressure on said third switch, with the delay time sufficient in duration to allow the user to press said second membrane switch to permit continuous operation of said light source.

7. The laser sight of claim 6 wherein the light of a second light source is emitted from the front face of said chassis wherein the light of the second light source is visible only when viewed with night vision goggles.

8. The laser sight of claim 1 wherein the light of a second light source is emitted from the front face of said chassis wherein the light of the second light source is a standard incandescent bulb to act as a flash light.

9. The laser sight of claim 7 wherein said battery pack utilizes commercially available size AAAA batteries.

10. The laser sight of claim 9 wherein said battery pack is electrically connected to the frame of said handgun by a spring-loaded pin within said chassis such that said pin maintains electrical contact with said battery pack when said chassis recoils with the slide of said handgun during firing.

11. The laser sight of claim 10 with said chassis further comprising a first set of adjustment screws on the front face of said chassis for said first light source and a second set of adjustment screws on the front face of said chassis for said second light source, wherein said first set of adjustment screws can align the light from said first light source relative to the position of the barrel of said handgun and said second set of adjustment screws can align the light from said second light source relative to the position of the barrel of said handgun.

12. The laser sight of claim 11 where said first membrane switch further comprises at least one button that can be activated by the user and select between said first light source and said second light source.

* * * * *